US010450624B2

(12) United States Patent
Fechte-Heinen et al.

(10) Patent No.: US 10,450,624 B2
(45) Date of Patent: Oct. 22, 2019

(54) METHOD FOR PRODUCING A FLAT PRODUCT FROM AN IRON-BASED SHAPE MEMORY ALLOY

(71) Applicant: THYSSENKRUPP STEEL EUROPE AG, Duisburg (DE)

(72) Inventors: Rainer Fechte-Heinen, Bottrop (DE); Christian Höckling, Mülheim an der Ruhr (DE); Lothar Patberg, Moers (DE); Jens-Ulrik Becker, Duisburg (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 836 days.

(21) Appl. No.: 14/903,551

(22) PCT Filed: Jul. 24, 2013

(86) PCT No.: PCT/EP2013/065656
§ 371 (c)(1),
(2) Date: Jan. 7, 2016

(87) PCT Pub. No.: WO2015/003755
PCT Pub. Date: Jan. 15, 2015

(65) Prior Publication Data

US 2016/0145708 A1 May 26, 2016

(30) Foreign Application Priority Data

Jul. 10, 2013 (EP) ..... 13175870

(51) Int. Cl.
*C21D 9/46* (2006.01)
*B22D 11/06* (2006.01)
(Continued)

(52) U.S. Cl.
CPC ..... *C21D 9/46* (2013.01); *B21B 1/46* (2013.01); *B22D 11/001* (2013.01);
(Continued)

(58) Field of Classification Search
CPC ..... B22D 11/0622; C21D 9/46
(Continued)

(56) References Cited

U.S. PATENT DOCUMENTS 5,901,777 A 5/1999 Matsumura et al.
6,358,338 B1 3/2002 Matsumura et al.
(Continued)

FOREIGN PATENT DOCUMENTS

CN 101705440 A 5/2010
CN 102796951 A 11/2012
(Continued)

OTHER PUBLICATIONS

English language Abstract for CN101705440A.
(Continued)

*Primary Examiner* — Weiping Zhu
(74) *Attorney, Agent, or Firm* — Lathrop Gage L.L.P.

(57) ABSTRACT

Methods for producing a flat product from an iron-based shape memory alloy may involve casting a melt comprised of iron, alloying elements, and impurities into a strip having a thickness of 1-30 mm and cooling the melt as the strip is formed. A twin-roll caster may be employed to help cool and form the melt into the strip. The resultant flat product is highly resistant to bending and is robust under pressure and torsion.

5 Claims, 2 Drawing Sheets

(51) Int. Cl.

| | |
|---|---|
| ***B22D 11/12*** | (2006.01) |
| ***C22F 1/00*** | (2006.01) |
| ***C22C 38/00*** | (2006.01) |
| ***C22C 38/34*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/58*** | (2006.01) |
| ***B21B 1/46*** | (2006.01) |
| ***B22D 11/00*** | (2006.01) |
| ***B22D 11/041*** | (2006.01) |
| ***C21D 6/00*** | (2006.01) |
| ***C21D 8/02*** | (2006.01) |
| ***C22C 38/42*** | (2006.01) |

(52) U.S. Cl.

CPC ..... *B22D 11/041* (2013.01); *B22D 11/0622* (2013.01); *B22D 11/1206* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/58* (2013.01); *C22F 1/006* (2013.01); *B21B 1/463* (2013.01)

(58) Field of Classification Search

USPC ..... 148/541

See application file for complete search history.

(56) References Cited

U.S. PATENT DOCUMENTS

| | | | | |
|---|---|---|---|---|
| 2004/0074628 | A1 | 4/2004 | Engl et al. | |
| 2007/0199631 | A1 | 8/2007 | Engl et al. | |
| 2009/0010793 | A1* | 1/2009 | Becker | C21D 6/005 420/38 |

FOREIGN PATENT DOCUMENTS

| | | | |
|---|---|---|---|
| CN | 102796954 | A | 11/2012 |
| CN | 102936701 | A | 2/2013 |
| EP | 1 067 203 | A1 | 1/2001 |
| EP | 1 348 772 | A1 | 10/2003 |
| EP | 1 807 542 | A1 | 7/2007 |
| JP | S61201725 | A | 9/1986 |
| JP | S62 112751 | A | 5/1987 |
| JP | H02 182354 | A | 7/1990 |
| JP | 2001-226747 | A | 8/2001 |
| JP | 2003105438 | A | 4/2003 |
| JP | 2004515362 | A | 5/2004 |
| JP | 2005146320 | A | 6/2005 |
| JP | 2009-279633 | A | 12/2009 |
| JP | 2010-156041 | A | 7/2010 |
| KR | 100 650 562 | B1 | 11/2006 |
| KR | 100 862 768 | B1 | 10/2008 |
| KR | 100 887 119 | B1 | 3/2009 |

OTHER PUBLICATIONS

English language Abstract for CN102796951A.
English language Abstract for CN102796954A.
English language Abstract for CN102936701A.
English language Abstract for JP2003105438A.
English language Abstract for JPS61201725A.
German Language International Search Report for International patent application No. PCT/EP2013/065656; dated Jun. 12, 2014.
English translation of International Search Report for International patent application No. PCT/EP2013/065656; dated Jun. 12, 2014.
English translation of the abstract of JP H02 182354 A.
English translation of the abstract of JP S62 112751 A.
English translation of the abstract of JP 2005 146320 A.
German language International Preliminary Examination Report for International patent application No. PCT/EP2013/065656; dated Oct. 26, 2015.
English translation of the abstract of KR 100 650 562 B1.
English translation of the abstract of KR 100 862 768 B1.
English translation of the abstract of KR 100 887 119 B1.
Baruj A et al: "Improvement of shape memory properties of NbC containing Fe—Mn—Si based shape memory alloys by simple thermomechanical treatments", Materials Science and Engineering A: Structural Materials: Properties, Microstructures and Processing, Elsevier BV, NL, Bd. 378, Nr. 1-2, Jul. 25, 2004 (Jul. 25, 2004), Seiten 333-336, XP004597347, ISSN: 0921-5093, DOI: 10.1 016/J.MSEA.2003.1 0.357.

* cited by examiner

METHOD FOR PRODUCING A FLAT PRODUCT FROM AN IRON-BASED SHAPE MEMORY ALLOY

CROSS REFERENCE TO RELATED APPLICATIONS

This application is a U.S. National Stage Entry of International Patent Application Serial Number PCT/EP2013/065656, filed Jul. 24, 2013, which claims priority to German Patent Application No. EP 13175870.8 filed Jul. 10, 2013, the entire contents of both of which are incorporated herein by reference.

FIELD

The present disclosure relates to methods for producing flat products from iron-based shape memory alloys.

BACKGROUND

The prior art—for example, JP 62 112 751 A—reveals the possibility of producing foils or wires by strip casting methods. Strip casting sees the melt cast in a casting means wherein the casting region, or the holdup region in which the cast strip is shaped, is bounded on at least one longitudinal side by a wall which is advanced continuously during the casting operation and is cooled.

One example of a near-net-shape continuous casting method of this kind, and of a casting means for producing, for example, a flat steel product, is the two-roll casting means or "twin-roll caster". In a twin-roll caster, in casting operation, two casting rolls or rollers oriented axially parallel to one another rotate in opposite directions and, in the region of their narrowest spacing, bound a casting gap which defines the casting region. These casting rolls are greatly cooled in the process, causing the melt which impinges on them to solidify to form in each case a shell. The rotational direction of the casting rolls is selected such that the melt and, together with it, the shells formed from it on the casting rolls are transported into the casting gap. The shells which enter the casting gap are compressed under the action of a sufficient strip-forming force to form the cast strip, with the consequence of an at least approximate complete solidification.

The principle used by the so-called belt casters is different. In a casting means of this kind, liquid steel is cast via a supply system onto a circulating casting belt, on which the steel solidifies. The running direction of the belt is selected such that the melt is conveyed away from the supply system. Disposed above the lower casting belt may be a further casting belt, which circulates in the opposite direction from the first casting belt. Irrespective of whether one or two casting belts are provided, in the case of the methods specified above as well, at least one casting belt borders the region in which the cast strip is formed. The respective casting belt is cooled intensively, and so the melt which comes into contact with the relevant casting belt solidifies thereon to form a strip, which can be taken off by the casting belt.

The cast strip emerging from the respective casting means is taken off and cooled, and can be passed on for further processing. This further processing may comprise a heat treatment and/or hot rolling. An advantage of strip casting is that the worksteps which follow strip casting can be run through in a continuous, uninterrupted sequence.

Known from the abovementioned Japanese laid-open specification JP 62 112 751 A is an iron-based shape memory alloy which apart from iron has elements in particular from the group "Mn, Si" and in which in addition to these elements there may be additional amounts of Cr, Ni, Co, Mo, C, Al, Ca and rare earth elements. From alloys with compositions of this kind, it is said to be possible, by strip casting, to produce cast foils which are temperature-stable and corrosion-resistant as well.

DETAILED DESCRIPTION

Figure 1:
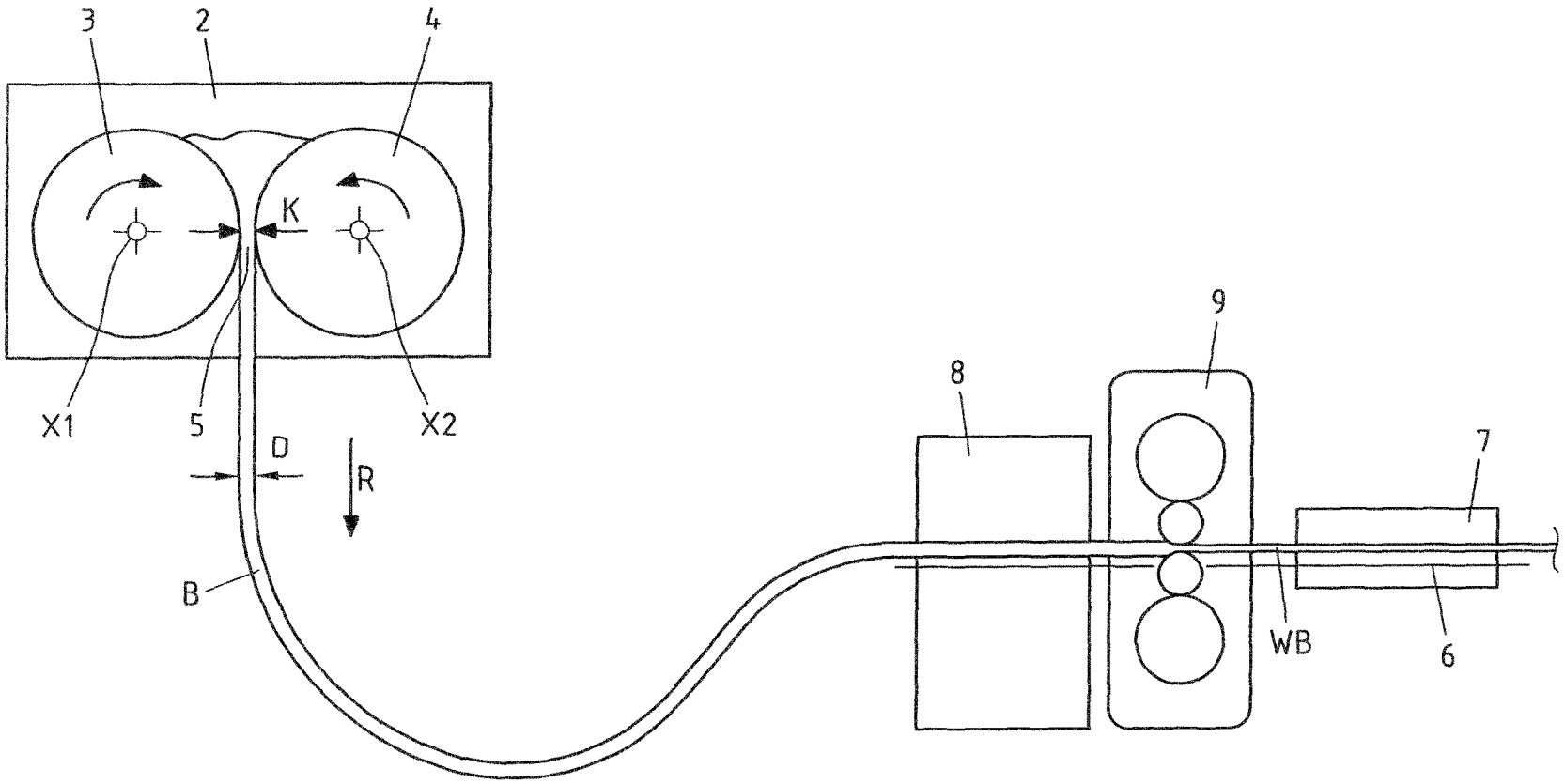
FIG. 1 is a schematic sectional view of an example apparatus comprising a twin-roll caster mechanism for producing flat products by strip casting.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure relates generally to methods for producing a flat product from an iron-based shape memory alloy, in which a melt which comprises at least as a main component iron, alloying elements and unavoidable impurities is cast in a casting means to form a cast strip and in the process is cooled.

That said one example object of the present disclosure is to propose cost-effective methods for producing flat products from an iron-based shape memory alloy that are bending resistant and are robust under pressure and torsion. The aim additionally is to produce a flat product which can be produced inexpensively and practically. Flat product is taken to encompass a cast and/or rolled strip or sheet and also plates, blanks, or the like that are obtained from such strip or sheet.

According to the first teaching of the method of the invention, the melt is cast to a strip in a casting means and cooled, ensuring the possibility of continuous casting operation, with the thickness of the strip being greater than 1 mm and less than 30 mm, and the casting region of said casting means being bounded at least on one of its longitudinal sides by a wall which moves in the casting direction during casting operation and which is cooled.

The strip thicknesses at which the cast and cooled strip of the invention leaves the casting gap, or is cast onto the casting belt, and solidifies are between more than 1 mm and 30 mm, more particularly between 1.5 mm and 20 mm, with further preference between 2 mm and 10 mm.

With the method of the invention it is possible to cast iron-based shape memory alloys as a flat product by means of a strip casting direction. In addition to the Fe—Mn—Si (—Cr(—Ni)) systems preferably employed, further systems are also conceivable, such as, for example, systems based on Fe—Ni, Fe—Ni—Al, Fe—Ni—Co—Ti, Fe—Ni—C, Fe—Ni—Nb, Fe—Ni—Si, Fe—Mn—Cr, Fe—Mn—Ni, Fe—Mn—Ni—Al, Fe—Mn—C, Fe—Mn—N, Fe—Cr—Si, Fe—Ga, Fe—Pd, Fe—Pt, Fe—Pd—Pt. On the basis of their use preferably for switching purposes, especially in high-temperature ranges, it is necessary to provide a material which meets the particular requirements. Depending on the utility, a material is used that has a minimum thickness of >1 mm, in order to be able to ensure the later component properties required, such as resistance to creasing and/or activity under bending resistance, for example.

According to a further refinement of the method, the casting means used is a twin-roll caster or a belt caster. It has emerged that the melt of the invention can be produced preferably via the stated strip casting means. Strip casting is outstandingly suitable for iron-based shape memory alloys, since relative to conventional casting, more particularly continuous casting, there is no need to use casting powder, and so it is possible to prevent casting problems occurring in the presence in particular of high levels of highly reactive alloying components, such as Mn, Si, Cr and/or Al, for example. Strip casting is further advantageous in particular if, for example, there are high alloying levels of highly segregating elements, such as Mn, Si, Cr and/or Ni, for example. Segregation can be substantially suppressed by rapid solidification. Furthermore, iron-based shape memory alloys have a low high-temperature ductility, and so the bending during casting is possible only for low thicknesses and/or is not absolutely necessary, depending on the casting means. A further characteristic is that iron-based shape memory alloys have a high hot forming resistance and are nevertheless thinly cast in substantially near-net-shape. The means can be used for the energy-efficient production of the flat product having shape memory properties. As already observed, in the case of a twin-roll caster, the axially parallel rolls each form a cooled boundary of the casting region, this boundary advancing continuously in the casting direction during casting operation, and this casting region being used to shape at least two longitudinal sides of the strip. Accordingly, a sufficiently high capacity can be provided with a single casting means, since the exit speeds of the cast strip are relatively high.

In the case of the belt caster, this function is taken on by a horizontally moving casting belt onto which the melt is cast to produce the strip. The advantage of using these belt casting means is that other method steps, such as hot rolling, for example, can follow on immediately and, in particular, the rolling effort is low, owing to the low casting thicknesses, and, on account of the compact nature of the casting means in question, an operating regime with the parameters required in terms of the material, especially with regard to the temperature, is possible in a particularly advantageous way. Since in a belt caster the melt is cast in the horizontal and cooled, the solidified strip undergoes no bending and, consequently, the stresses present in the strip itself are minor, thereby minimizing in particular the risk of cracks developing in the high-temperature region of the flat product produced.

It is advantageous, furthermore, if the melt, according to another refinement of the method of the invention, is cooled in contact with the moving wall or casting belt at a cooling rate of, in particular, at least 20 K/s, preferably 50 K/s, more preferably at least 100 K/s. The high speed of solidification allows a reduction to be achieved in segregation processes which have disadvantageous consequences for the material properties. The cooling rate is selected such that at the end of the casting operation, a solidified flat product is produced—for example, an iron-based strip composed of a shape memory alloy.

If an alloy-dependent roller pressure, expressed by what is called the RSF (roll separating force) or strip forming force (SFF), is set during casting with the twin-roll caster, it is possible to ensure substantially complete solidification right through the strip after emergence from the casting region, with high operational reliability. The specific roller pressure can be determined empirically and ensures a reliable strip casting operation.

If the strip passes through a warming apparatus prior to hot rolling, any heat loss occurring on emergence of the strip from the casting means can be compensated again, and the specific hot rolling temperature can be achieved in an operationally reliable way.

The strip speeds at which the cast strip emerges from the casting gap are in practice typically in the range from 0.06 to 3.0 m/s.

A particularly effective and economic production method can be provided by continuously supplying the cast strip emerging from the casting region to at least one rolling stand. The casting means may therefore directly supply at least one rolling stand with a cast strip for rolling, removing any need for handling of the cast strips between casting and rolling. Alternatively, the cast strip may also be cooled appropriately and heated again, if desired, at a later point in time, and rolled. Lastly, the hot strip is optionally cold-rolled, with the cold rolling taking place in at least one rolling pass.

In order to counteract embrittlement during the subsequent manufacturing and processing steps, it is possible in accordance with the invention to carry out an annealing treatment in hot-rolled and/or cold-rolled state at a temperature above the switching temperature for a period of 20 seconds to 48 hours.

An operationally reliable possibility for generating an iron-based flat product with shape memory effect provides for the strip emerging from the casting gap of the casting means, or the optionally cold-rolled strip which has solidified on the casting belt and subsequently, optionally, been additionally hot-rolled, to be heated, lastly, at least to the martensite finish ($M_F$) temperature of the respective alloy. The flat product produced in this way allows the impression of a component design by corresponding loading of the flat product, in which case, during loading, the temperature is raised to at least austenite finish temperature ($A_F$) and the load and the temperature>$A_F$ act on the flat product for at least 20 seconds. In the flat product of the invention, therefore, the shape memory effect is set to the desired component design.

After the casting of the strip, the cast strip can be subjected to hot rolling, in which case the initial hot-rolling temperature ought to be between 500° C. and $T_{Solidus}$−50° C. As a result of the hot-rolling steps which follow the casting and cooling processes in line, it is possible on the one hand to set the desired final thickness of the strip and on the other hand to set the surface consistency, and also to optimize the microstructure, by, for example, closing cavities which are still present in the cast state. The hot strip can also be subjected to cold rolling and thereby reduced further in its thickness.

In order, in accordance with a further teaching, to provide a flat product composed of an iron-based shape memory alloy having reinforcements through intercrystalline atoms (group 1) or by mixed crystal solidification (group 2) or with a microstructure composed of austenite, ε-martensite, and fine precipitations in the form of carbides, borides, nitrides and/or a hybrid form thereof (group 1+group 2), the melt contains 10 to 45 wt % of manganese and up to 12 wt % of silicon, and at least one further element from a group 1, with group 1 encompassing the elements N, B, and C and with the following statement being valid for the alloying fractions of the group 1 in weight percent:

$\Sigma N, C, 10 \cdot B \geq 0.005\%$, and/or comprises at least one further element from a group 2, the group 2 encompassing the elements Ti, Nb, W, V, and Zr and the following statement being valid for the alloying components of the group 2 in weight percent:

ΣTi, Nb, W, V, Zr≥0.01%, preferably ΣTi, Nb, W, V, Zr≥0.1%, it being possible optionally for at least one, or two or more, of the following fractions of alloying components to be present:

Cu≤20 wt %,
Cr≤20 wt %,
Al≤20 wt %,
Mg≤20 wt %,
Ni≤20 wt %,
O≤0.5 wt %,
Co≤20 wt %,
Mo≤20 wt %,
Ca≤0.5 wt %,
P≤0.5 wt %, and/or
S≤0.5 wt %.

It has emerged that by near-net-shape casting methods, it is possible to produce flat products from an iron-based shape memory alloy that possess, depending on alloying components, reinforcements by intercrystalline atoms (group 1) or by mixed crystal solidification (group 2) or a microstructure of austenite, ε-martensite, and optionally fine precipitations (group 1+group 2). In this case, the alloys processed in each case in accordance with the invention have a composition such that the desired microstructure condition is reliably produced. It has emerged that flat products composed of iron-based shape memory alloys can also be cast to a cast strip via a casting means, allowing a near-net-shape flat steel product to be produced. In the case of the applied strip casting method, a strip is produced which comprises precipitation pairs in the form of carbides, nitrides, borides or a hybrid form thereof, on the basis, for example, of the amounts of the alloying constituents as per the group 1 N, C, B in conjunction with the elements of group 2, Ti, Nb, W, V, Zr, this strip providing the desired microstructure combination to achieve a shape memory effect, in conjunction with the iron, manganese, and silicon contents of the alloy. As a possible constituent, the alloy of the invention comprises at least one of the elements boron, nitrogen and/or carbon, and at least one of the elements titanium, niobium, tungsten, vanadium or zirconium, and, as the balance, iron, manganese, silicon and unavoidable impurities. The elements of groups 1 and 2 prove particularly advantageous since they lead to the desired precipitations, which serve as nucleus cells for the desired phase transformation at the corresponding sites. With the amounts of these elements as stated in the claims, the production method of the invention permits operationally reliable production of a flat product with shape memory effect. In the flat steel product produced in accordance with the invention, manganese in amounts of 12 wt % to 45 wt % promotes stabilization of the austenite in the material. In order to achieve this effect reliably, the Mn content may be situated between 20 wt % and in particular 35 wt %. Si contents of 1 wt % up to 12 wt % serve to ensure the reversibility of the transformation from martensite to austenite in the flat products of the invention. Preferred Si contents are 3 wt % to 10 wt %. Adjustments appropriate in practice for amounts of N, B, C and/or Ti, Nb, W, Zr come about when the C content is limited to a maximum of 0.5 wt %, more particularly to a maximum of 0.2 wt %. The B content is restricted appropriately to a maximum of 0.5 wt %, more particularly to a maximum of 0.05 wt %. The N content is restricted appropriately to 0.5 wt %, more particularly to a maximum of 0.2 wt %. Preferably, furthermore, the amount of elements of group 2 (Ti, Nb, W, V, Zr) is limited to a maximum of 2.0 wt %, more particularly to a maximum of 1.5 wt % individually. It may be advantageous for one or more of the elements of group 1 (N, B, C) to be added in each case in conjunction with one or more of the elements of group 2 (Ti, Nb, W, V, Zr) in the more narrowly confined amounts indicated, while the other elements of group 1 (N, B, C) are added within the maximum specification permitted in accordance with the invention. The same may also be true conversely for the two groups.

Although it is regarded as possible in accordance with the invention for the group of the alloying elements of an iron-based shape memory alloy of the invention to be confined, apart from Fe, Mn, Si and unavoidable impurities, to at least one element of group 1 and at least one further element of group 2, it may under certain circumstances be purposeful, for the setting of particular properties of the flat steel products obtained, to add, optionally, one or more of the elements from group Cu, Cr, Al, Mg, Mo, Co, Ni, O, P, S, Ca to the shape memory alloy. The contents ranges contemplated for this purpose in accordance with the invention in each case run as follows:

Cu: ≤20 wt %, preferably ≤10 wt %,
Cr: ≤20 wt %, preferably ≤10 wt %,
Al: ≤20 wt %, preferably ≤10 wt %,
Mg: ≤20 wt %, preferably ≤10 wt %,
Mo: ≤20 wt %, preferably ≤10 wt %,
Co: ≤20 wt %, preferably ≤10 wt %,
Ni: ≤20 wt %, preferably ≤10 wt %,
O: ≤0.5 wt %,
P: ≤0.5 wt %,
S: ≤0.5 wt %,
Ca: ≤0.5 wt %.

Through the addition of Cu, Mo and Co it is possible, individually or in combination, to improve the shape memory effect, whereas the effect of Cr, Al and Mg, individually or in combination, lies primarily in an improvement in the corrosion resistance. The individually stated elements may be alloyed in at up to 20 wt %, preferably up to 10 wt %. In order to avoid adverse effects of S, P and O, they are restricted to a maximum of 0.5 wt %, preferably a maximum of 0.2 wt %, more preferably a maximum of 0.1 wt %. Ni supports the stabilization of the austenite in the microstructure, and improves the formability of the material. When S is present, Ca may be alloyed in at not more than 0.5 wt %, in order to suppress unwanted binding of Mn in the form of MnS. The amount is restricted to a maximum of 0.5 wt %, preferably a maximum of 0.2 wt %, more preferably a maximum of 0.1 wt %.

In order to be able to utilize the positive effects of the optionally added alloying elements Cr and Ni, the melt may in each case optionally comprise at least 0.1 wt % of Ni and at least 0.2 wt % of Cr.

According to a further refinement, the shape memory alloy has the following alloying constituents in weight percent:

25.0 wt %≤Mn≤32.0 wt %,
3.0 wt %≤Si≤10.0 wt %,
3.0 wt %≤Cr≤10.0 wt %,
0.1 wt %≤Ni≤6.0 wt %, preferably 4.0 wt %,
P≤0.1 wt %,
S≤0.1 wt %,
Mo≤0.5 wt %,
Cu≤0.5 wt %,
Al≤5.0 wt %,
Mg≤5.0 wt %, O≤0.1 wt %, Ca≤0.1 wt %, Co≤0.5 wt %, there being at least one element from a group 1 of elements present, the group 1 consisting of the elements N, C, and B with the following amounts N≤0.1 wt %, C≤0.1 wt %, B≤0.1 wt % and the following statement being valid for the sum of the amounts of the alloying constituents of group 1:

ΣN, C, 10·B≥0.005%, and/or where there is at least one element of a group 2 of elements, group 2 consists of the elements Ti, Nb, W, V, and Zr with the following amounts Ti≤1.5 wt %, Nb≤1.5 wt %, W≤1.5 wt %, V≤1.5 wt %, Zr≤1.5 wt %, and the following statement is valid for the sum of the amounts of the alloying components of group 2:

ΣTi, Nb, W, V, Zr≥0.01%, preferably ΣTi, Nb, W, V, Zr≥0.1% and, building thereon, according to a further refinement of the invention, the following statement is valid for the ratio of the sum of the alloying components of group 1 and of group 2 in atom %:

$$0.5 \leq \frac{\sum_{Group\ 2}}{\sum_{Group\ 1}} \leq 2.0,$$

with the balance being iron and unavoidable impurities.

Besides the stated possible components of the shape memory alloy, the alloying components Mn, Si, Cr, Ni and also one of the elements of group 1 (N, C, B) and/or one of the elements of group 2 (Ti, Nb, W, V, Zr), the shape memory alloy may further comprise the elements P, S, Mo, Cu, Al, Mg, O, Ca or Co, optionally, which at up to the stated values may develop advantageous effects. The precipitations which influence the shape memory effect and whose formation is influenced by the ratio of the two element groups, group 1 and group 2, to one another exhibit a significant, positive influence on the shape memory effect, provided the sum of the components of the elements of group 2 in atom % of the alloy, expressed as a ratio to the sum of the alloying components of group 1 in atom %, is in the range from 0.5 to 2.0. By this means a specific stochiometric ratio of the alloying elements of group 1 and group 2 is established. It has been found that with this ratio specifically for the alloying components in atom % of group 2 relative to group 1, the formation of precipitates is particularly favorable and supports the shape memory effect. If the stated ratio, for example, is less than 0.5, the precipitation elements may not be bound in the form of N, C and/or B and the shape memory effect is reduced, since the elements of group 1 are present in dissolved form in the microstructure. As a result, moreover, there is an adverse effect observed on the reversibility of the phase transformation, i.e., of the conversion from martensite back into austenite. If the ratio thus formed between the sums of the alloying constituents is greater than 2, unwanted solidifications come about, because of the elements of group 2, which are intercalated in the microstructure in the form of free atoms and thereby in turn hinder the shape memory effect.

The purpose of the manganese content of 25 wt % to 32 wt % is to stabilize the austenite in the microstructure, and it has an influence in particular over the switching temperature of the shape memory material. Below an Mn content of 25.0 wt % there is increased formation of ferrite, which is disadvantageous for the shape memory effect. If the Mn content is raised above 32 wt %, there is an excessive fall in the desired switching temperature, causing the switching temperature and the possible use temperatures of a corresponding component to be too close to one another.

Silicon serves to ensure the reversibility of the phase transformation from martensite into austenite. Contents below 3.0 wt % of Si lead to a reduction in the shape memory effect. Above 10 wt %, embrittlement of the material may be observed. At Si contents above 10 wt % moreover, there is increased formation of the unfavorable ferritic microstructure.

In order to ensure sufficient corrosion resistance, the shape memory alloy contains at least 3.0 wt % of Cr. An increase in the Cr content to above 10 wt % again promotes formation of ferrite, with its adverse consequences, as already stated, for the shape memory effect.

Nickel, lastly, serves to stabilize the austenitic microstructure and, moreover, improves the formability of the material. However, an Ni content of below 0.1 wt % has no significant effect on the properties of the material. Ni contents of more than 6.0 wt %, though, lead to slight improvements in the aforementioned properties, only in conjunction with an increased Cr fraction, and consequently, for cost savings, the Ni content is confined to a maximum of 6.0 wt %, preferably to a maximum of 4.0 wt %.

In order to ensure that the desired precipitations take place without adverse consequences for other properties of the shape memory alloy, a maximum of 0.1 wt % is envisaged as an upper limit for all of the elements of group 1, i.e., N, C, and B. The elements of group 2 (Ti, Nb, W, V, Zr) may be present at a minimum level of 0.01 wt %, this level applying at least to one element of this group. With a weight fraction of at least 0.01 wt %, preferably at least 0.1 wt %, for Ti, Nb, W, V and/or Zr, the shape memory effect is influenced positively. The reversibility of the phase transformation, in particular, can be ensured by a corresponding level of one of the group 2 elements. With preference each individual element of group 2 does not exceed the maximum level of 1.5 wt %, and more preferably the maximum amount of each individual element is 1.2 wt % or a maximum of 1.0 wt %, in order to counteract unwanted solidifications.

According to a first refinement of the shape memory alloy of the invention, the Cr content in weight percent is 3.0 wt %≤Cr≤10.0 wt %, thus achieving an effective compromise between ferrite formation and corrosion resistance of the shape memory alloy. Ferrite formation counteracts the shape memory effect, since ferrite does not enter into phase transformation and has a tendency toward premature plastic deformation.

According to a further refinement of the shape memory alloy, the difference between the Cr content and the Ni content is subject to the following relationship: 0 wt %≤Cr—Ni≤6.0 wt %. The maximum difference between the amounts of Cr and Ni is therefore limited to 6 wt %. It has emerged that an increase in the difference between the chromium and nickel contents to more than 6 wt % does not lead to any significant improvements in the mechanical properties, and instead leads to the embrittlement of the material. A drop in the difference to below 0 wt %, therefore meaning that the nickel content is greater than the chromium content, in contrast, may have adverse consequences for the switching temperature, by lowering it and causing it to come closer to the service temperature of the material.

According to one further refinement of the shape memory alloy, the ratio in atom % of the sum of the alloying components of group 1 and group 2 is subject to the following relationship:

$$0.5 \leq \frac{\sum_{Group\ 2}}{\sum_{Group\ 1}} \leq 1.5,$$

and so on the one hand it is possible for the shape memory effect through sufficient formation of precipitations to be fully ensured and on the other hand it is possible for solidifications on the basis of free atoms of group 2 in the microstructure to be significantly reduced.

A further refinement of the shape memory alloy has N, C and/or B in the following amounts in weight percent:

0.005 wt %≤N≤0.1 wt %, 0.005 wt %≤C≤0.1 wt % and/or 0.0005 wt %≤B≤0.1 wt %.

If the shape memory alloy comprises the elements N and/or C in amounts of at least 0.005 wt % and/or B in an amount of at least 0.0005 wt %, these minimum amounts can be used to improve the formation of precipitations. Through the upper limit of 0.1 wt %, preferably of 0.05 wt %, more preferably 0.01 wt % of B, it is ensured that the oxidation resistance of the shape memory alloy does not drop too sharply. At the same time, the contents of N and C are each limited to a maximum of 0.1 wt %, preferably a maximum of 0.07 wt %, and so the precipitations do not become too great with the possible adverse consequences for mechanical properties of the alloy.

In a further refinement of the alloy, the alloy amounts of the alloying components of the elements of group 2 are limited. In accordance with this embodiment, the alloying components of the elements of group 2 are as follows:

Ti≤1.2 wt %,

Nb≤1.2 wt %,

W≤1.2 wt %,

V≤1.2 wt %,

Zr≤1.2 wt %, and preferably the upper limit is lowered to 1.0 wt % for each individual element of group 2. This further reduces the development of solidifications, and so the shape memory alloy has good forming properties.

Lastly, in accordance with a further embodiment of the shape memory alloy, sulfur, phosphorus, and oxygen ought to be limited to contents of not more than 0.1 wt %, preferably to not more than 0.05 wt %, and more preferably to not more than 0.03 wt %, in order to reduce their adverse influences, on corrosion resistance, for example. Molybdenum, copper, and cobalt can be alloyed in individually or in various combinations in order to improve the shape memory effect. A corresponding influence is limited in each case to contents of not more than 0.5 wt %. Aluminum and magnesium, individually or in combination, may contribute to an improvement in the corrosion resistance, and at the same time also bring about a reduction in the density of the alloy. Their amount is limited to a maximum of 5 wt %, preferably to a maximum of 2.0 wt %, more preferably to a maximum of 1.0 wt %.

According to a further refinement, calcium can be alloyed in for binding any sulfur present, in order to prevent unwanted binding of sulfur with manganese in the form of MnS. In order not to reduce the corrosion resistance and in order to prevent excessive impurities through Ca, the amount of Ca is limited to a maximum of 0.015 wt %, preferably to a maximum of 0.01 wt %.

According to a second teaching of the present invention, the object identified above is also achieved by a flat product with shape memory effect, consisting of an alloy which as well as iron and production-related impurities comprises manganese at 12 wt % to 24 wt %, silicon at 1 wt % to 12 wt %, and at least one further element of a group 1, the group 1 comprising the elements (N, B, C), and the alloying components of group 1 in weight percent being subject to the following relationship:

ΣN, C, 10·B≥0.005%, and/or there is at least one further element of a group 2, the group 2 comprising the elements (Ti, Nb, W, V, Zr), and the following relationship applying to the alloying components of group 2 in weight percent:

ΣTi, Nb, W, V, Zr≥0.01%, and the following fractions of alloying components may be present:

Cu≤20 wt %,

Cr≤20 wt %,

Al≤20 wt %,

Mg≤20 wt %,

Ni≤20 wt %,

O≤0.5 wt %,

Co≤20 wt %,

Mo≤20 wt %,

Ca≤0.5 wt %,

P≤0.5 wt %,

S≤0.5 wt % and the flat product has been strip-cast.

Further refinements, particularly of the alloy composition of the flat product of the invention, and manufacturing parameters for production, are evident from the above description of the production method.

The invention is to be elucidated in more detail hereinafter with reference to working examples in conjunction with the drawing.

Figure 2:
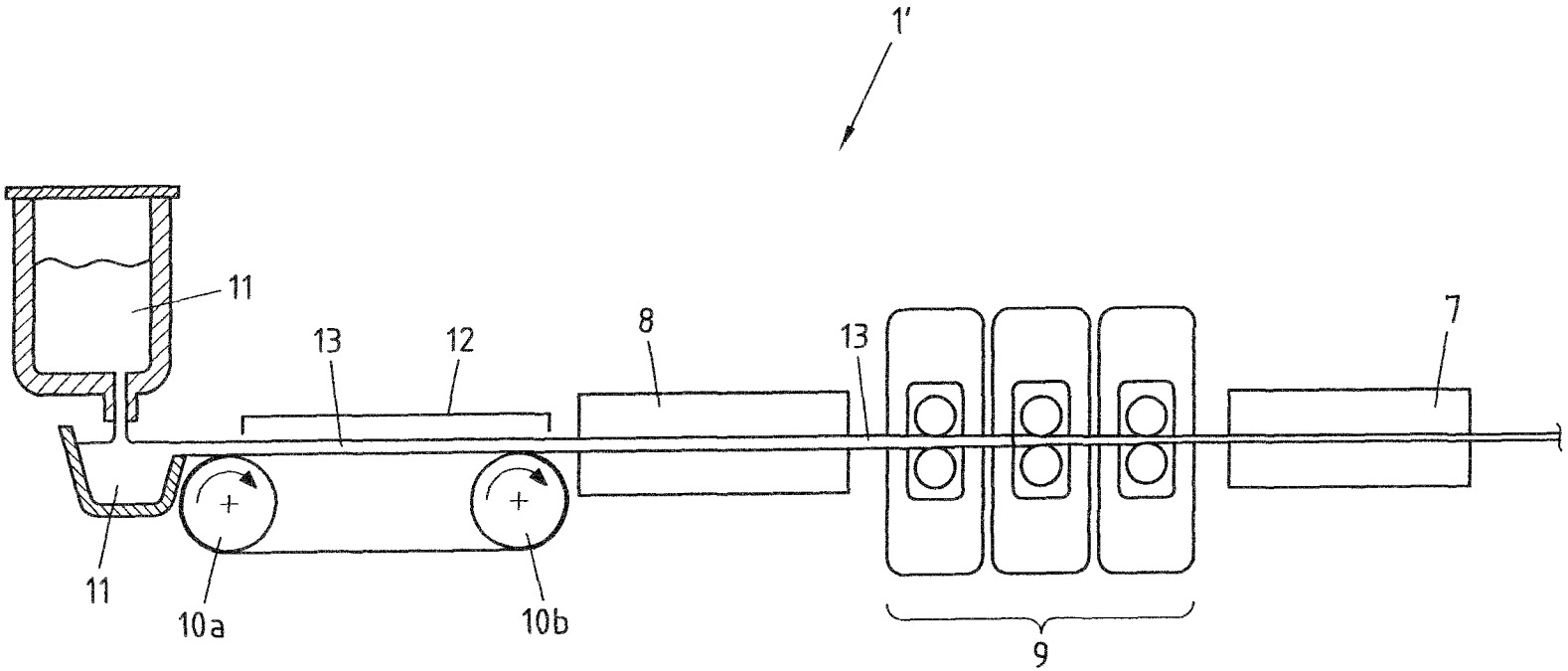
FIG. 2 is a schematic sectional view of an example apparatus comprising a belt caster for producing flat products by strip casting.

FIGS. 1 and 2 each show schematically an apparatus for producing a flat product by strip casting, in a schematic sectional view.

The working examples listed in table 1 were cast using the casting means (twin-roll caster) shown in FIG. 1, and their shape memory effect was examined. It was found that in comparison to the prior art, the working examples showed a lower tendency toward unwanted solidifications and at the same time had a good shape memory effect with a sufficiently high switching temperature. In simulation trials with identical melts, it was found that the working examples can also be produced by strip casting in a belt caster, as shown in FIG. 2.

The line 1 for producing a cast strip B comprises a casting means 2, which is constructed as a conventional twin-roll caster and, accordingly, has two rolls 3 and 4 which rotate oppositely to one another around axes X1 and X2 which are axially parallel to one another and are aligned at the same height. The rolls 3 and 4 are arranged with a spacing which sets the thickness D of the cast strip B to be produced, and so bound, at the longitudinal sides of the strip, a casting region 5, in the form of a casting gap, in which the cast strip B is shaped. At its narrow sides, the casting region 5 is sealed in a way which is also known, by means of side plates, not visible here, which are pressed against the end faces of the rolls 3 and 4.

During casting operation, the rolls 3 and 4, which are intensively cooled, for example, rotate and thus form a boundary at the longitudinal sides of a casting mold which is formed by the rolls 3 and 4 and by the side plates which move along continuously in casting operation. The direction of rotation of the rolls 3 and 4 is directed in this case, in the direction R of gravitational force, into the casting region 5, and so, as a consequence of the rotation, melt S is conveyed from a melt pool, in the space above the casting region 5, between the rolls 3 and 4, into the casting region 5. This melt S solidifies when it comes into contact with the circumferential surface of the rolls 3 and 4, on account of the intensive heat removal that takes place there, and forms a shell in each case. The shells adhering to the rolls 3 and 4 are conveyed by the rotation of the rolls 3 and 4 into the casting region 5, where they are pressed together under the effect of a strip-forming force SFF to form the cast strip B. The cooling output effective in the casting region 5 and the strip-forming force SFF are harmonized with one another in such a way that the cast strip B emerging continuously from the casting region 5 is very largely completely solidified.

The strip B emerging from the casting region 5 is first of all conveyed away vertically in the direction of gravitational force, and is subsequently bended in a known way, in a continuously curved arc, into a horizontally aligned conveying section 6. On the conveying section 6, the cast strip B may subsequently travel through a heating device 8, in which the strip B is heated to at least hot-rolling start temperature. The cast strip B heated accordingly is then rolled to form hot strip WB in at least one hot-rolling stand 9. Through targeted cooling 7 after the hot-rolling stand it is possible to influence the formation of the microstructure. By cooling of the strip to about 400° C., the coarsening of the precipitations can be suppressed. The hot strip WB can be subsequently coiled and otherwise prepared for onward transport.

Using the casting means shown in FIG. 1, a strip B was cast from each of the three molten steels Z1, Z2 and Z3 indicated in table 1. It was found that after the cooling treatment, the cast strip B had a microstructure comprising austenite, ε-martensite, and finely distributed precipitations in the form of NbC, NbN, VC, VN, TiN, TiC and/or hybrid forms thereof, allowing good shape memory properties to be determined.

The described heat treatment by means of the heating device 8, and the hot rolling with the hot-rolling stand 9, and the cooling step using the cooling device 7, are method steps that are merely optional.

The belt caster 1' shown in FIG. 2 uses a casting belt 10 onto which the molten steel 11 with the composition of the invention is cast. This takes place in the region of the first bending roll 10*a* of the casting belt. The highly cooled casting belt is returned again via the second bending roll 10*b*. Cover means 12 allow the further transport of the cast strip 13 to take place as far as possible without heat loss and optionally under an inert gas atmosphere to hot rolling 9. Instead of the cover means 12, alternatively, a second casting belt (not shown here) may be provided that runs in the opposite direction from the first casting belt 10. Immediately ahead of the hot-rolling stand 9, there may also be heating means 8 provided, which heat the cast strip 13 to at least hot-rolling start temperature.

By way of the quenching 7 after hot rolling it is possible to set a desired microstructure in the strip, thus producing a flat product comprising a shape memory alloy, and this product can subsequently be coiled or otherwise prepared for onward transport.

It would be appreciated that a hot-rolling device, as depicted by way of example in FIGS. 1 and 2, is not absolutely necessary. In order to establish the mixed microstructure, the cast strip emerging from the casting region can be cooled directly, without rolling.

TABLE 1

| Trial/ | Weight % | | | | | | | | | | | |
|---|---|---|---|---|---|---|---|---|---|---|---|---|
| Element | Fe | Mn | Si | Cr | Ni | Nb | Ti | V | W | Zr | N | C |
| Working example 1 | 60.437 | 27.8 | 5.8 | 4.9 | 0.51 | 0.46 | 0.015 | 0 | 0 | 0 | 0.004 | 0.061 |
| Working example 2 | 59.851 | 27.8 | 6 | 5.2 | 0.51 | 0.49 | 0.02 | 0 | 0 | 0 | 0.0192 | 0.068 |
| Working example 3 | 58.225 | 29 | 6 | 5.2 | 0.65 | 0.49 | 0.01 | 0.06 | 0 | 0 | 0.011 | 0.057 |

| Trial/ | Weight % | | | | | | | | | | Ratio in atom % Group 2/ | Cr – |
|---|---|---|---|---|---|---|---|---|---|---|---|---|
| Element | B | P | S | O | Ca | Mo | Cu | Al | Mg | Co | Group 1 | Ni |
| Working example 1 | 0 | 0.005 | 0.008 | 0 | 0 | 0 | 0 | 0 | 0 | 0 | 0.98 | 4.39 |
| Working example 2 | 0 | 0.034 | 0.008 | 0 | 0 | 0 | 0 | 0 | 0 | 0 | 0.81 | 4.69 |
| Working example 3 | 0 | 0.029 | 0.001 | 0 | 0 | 0.121 | 0.119 | 0 | 0 | 0.027 | 1.20 | 4.55 |

What is claimed is:

1. A method for producing a flat product with a shape memory effect from an iron-based shape memory alloy, the method comprising:

(a) casting a melt that comprises alloying elements, impurities, and primarily iron in a casting device to form a strip having a thickness of 1-30 mm, wherein the casting device comprises a twin-roll caster or a belt caster;

(b) cooling the melt as the strip is formed with a wall disposed along a longitudinal side of a region of the casting device, wherein the wall moves in a direction along which the strip is emitted from the region of the casting device, wherein the melt in contact with the wall is cooled at a cooling rate of at least 20 K/s;

(c) after the cast and cooled strip leaves a casting gap of the twin-roll caster or is cast and cooled onto a casting belt of the belt caster, one of:

(i) solidifying, after emerging the strip from the casting gap or locating the strip which has solidified on the casting belt, by continuously supplying the strip to at least one rolling stand and hot-rolling the strip; or (ii) solidifying, after emerging the strip from the casting gap or locating the strip which has solidified on the casting belt, by cooling the strip and heating the strip at a later point in time for hot-rolling the strip; or (iii) solidifying, after emerging the strip from the casting gap or locating the strip which has solidified on the casting belt, by continuously supplying the strip to at least one rolling stand and hot-rolling the strip and lastly cold-rolling the strip; or (iv) solidifying, after emerging the strip from the casting gap or locating the strip which has solidified on the casting belt, by cooling the strip and heating the strip at a later point in time for hot-rolling the strip and lastly cold-rolling the strip; and (d) heating the hot-rolled strip or cold-rolled strip at least to a martensite finish temperature ($M_F$) of the alloying elements of the melt, wherein the shape memory effect is impressed by a corresponding loading of the flat product, wherein during the loading, the temperature is raised to at least an austenite finish temperature ($A_F$) and the load and the temperature greater than ($A_F$) act on the flat product for at least 20 seconds, wherein the melt comprises at least one of:

(i) manganese at 12 wt % to 45 wt %;

(ii) silicon at 1 wt % to 12 wt %;

(iii) at least one element from a group 1 that consists of elements N, B, and C such that $\Sigma N, C, 10 \cdot B \geq 0.005\%$ in weight percent; or (iv) at least one element from a group 2 that consists of elements Ti, Nb, W, V, and Zr such that $\Sigma$Ti, Nb, W, V, Zr 0.01% in weight percent.

2. The method of claim 1 wherein the casting device comprises a belt caster, wherein the melt in contact with a belt of the belt caster is cooled at a rate of at least 20 K/s.

3. The method of claim 1 further comprising:

passing the strip through a warming apparatus; and hot rolling the strip after the strip passes through the warming apparatus.

4. The method of claim 1 further comprising directly cooling the strip emitted from the region of the casting device.

5. The method of claim 1 wherein the melt further comprises one or more of:

Cu≤20 wt %,
Cr≤20 wt %,
Al≤20 wt %,
Mg≤20 wt %,
Ni≤20 wt %,
O≤0.5 wt %,
Co≤20 wt %,
Mo≤20 wt %,
Ca≤0.5 wt %,
P≤0.5 wt %, or
S≤0.5 wt %.

* * * * *